US006570478B2

(12) United States Patent
Meeks

(10) Patent No.: US 6,570,478 B2
(45) Date of Patent: May 27, 2003

(54) SURFACE MOUNTED LOW PROFILE INDUCTOR

(75) Inventor: John Meeks, Cincinnati, OH (US)

(73) Assignee: Standex Electronics, Salem, NH (US)

( * ) Notice: Subject to any disclaimer, the term of this patent is extended or adjusted under 35 U.S.C. 154(b) by 0 days.

(21) Appl. No.: 10/137,190

(22) Filed: Apr. 30, 2002

(65) Prior Publication Data

US 2002/0186117 A1 Dec. 12, 2002

Related U.S. Application Data

(63) Continuation-in-part of application No. 09/594,858, filed on Jun. 15, 2000, now abandoned.

(51) Int. Cl.[7] ..... H01F 27/28

(52) U.S. Cl. ..... 336/229; 336/65; 336/90; 336/192

(58) Field of Search ..... 336/90, 96, 83, 336/65, 92, 192, 229

(56) References Cited

U.S. PATENT DOCUMENTS 4,754,370 A * 6/1988 DeTizio et al. ..... 361/404
5,351,167 A * 9/1994 Wai et al. ..... 336/192
6,081,180 A * 6/2000 Fernandez et al. ..... 336/90

FOREIGN PATENT DOCUMENTS

JP 5-275253 * 10/1993

* cited by examiner

*Primary Examiner*—Tuyen T. Nguyen
(74) *Attorney, Agent, or Firm*—William B. Ritchie

(57) ABSTRACT

A low profile surface mountable toroid inductor. The apparatus features a one step molded housing which includes a cover and opposing mounting legs. The housing is molded in a liquid crystal polymer. The length of wire that provides the turns on the toroid also serves as the mounting pads as each end of the wire that is left exposed during the housing molding process is then wrapped around its corresponding leg to provide a mounting pad. The apparatus is able to achieve a thickness that is less or equal to 1.5 mm by eliminating the thickness of a prefabricated cover. Further, a flat surface can be molding into the housing so that the apparatus can be positioned with "pick and place" techniques. Also, the apparatus can be configured so that it can be mounted upside down as well. A blind hole is provided that orients the toroid within the mold and serves to prevent any gate vestige from protruding beyond the mounting surface as well as reducing mechanical stress on the press due to the different coefficients of thermal expansion of the respective components.

8 Claims, 3 Drawing Sheets

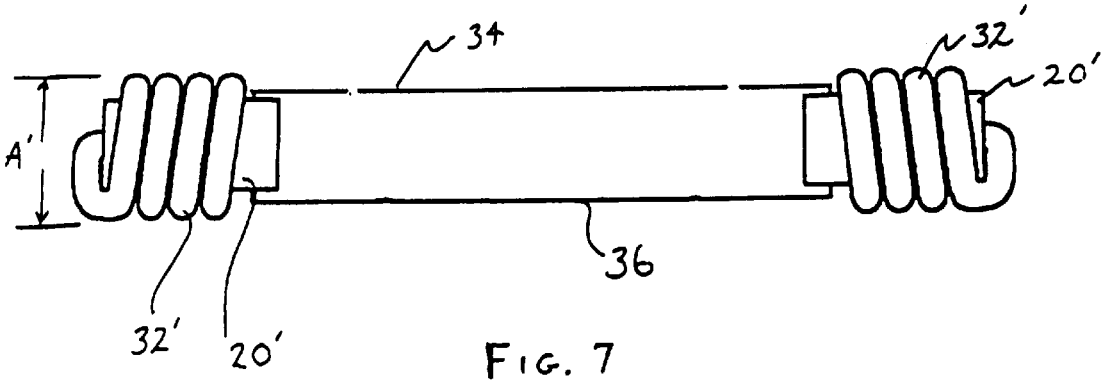
FIG. 7
FIG. 8
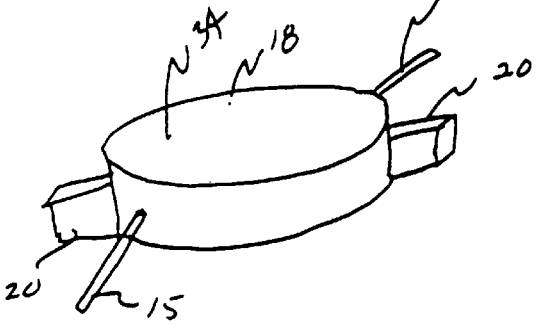
FIG. 9
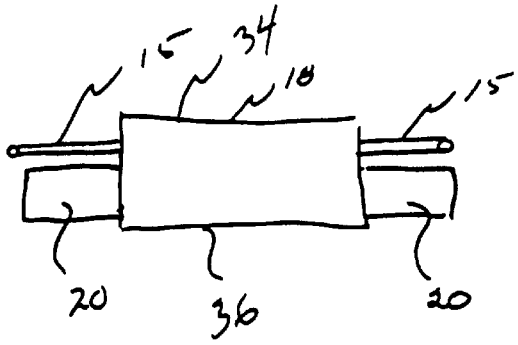

SURFACE MOUNTED LOW PROFILE INDUCTOR

RELATED APPLICATIONS

This application is a continuation in part of 09/594,858 filed Jun. 15, 2000, now abandoned.

FIELD OF THE INVENTION

The invention relates to the field of electronic components parts, in particular, low profile inductors that are intended to be surface mounted.

BACKGROUND OF THE INVENTION

The explosion in computer design, cellular telephones, etc., especially the interest in making such devices truly pocket-sized yet maintaining or even increasing overall performance has resulted in a quest for smaller and smaller component parts. The need for a surface mounted inductor having extremely low profile when mounted has been especially acute. Applications such as notebook, PC cards, wireless communication devices, handheld PDAs and the new line of Windows Powered (Windows CE-based) Pocket PCs are limited in size reduction to size of the largest parts. This problem has added further impetus to continue seeking methods to manufacture still smaller parts. The need for extremely low profile inductors surface mountable on a circuit board is especially acute. Of course, this need for a very small inductor must be weighed against the cost of manufacturing such a part. The goal, of course, is to achieve both . . . an extremely small profile and a reduced cost of manufacture.

One solution for this type of inductor is manufactured by Coilcraft of Cary, Ill. identified as their LPT3305 Series. This device uses toroid construction which minimizes electromagnetic interference and utilizes a ceramic cover so that the device can be installed using "pick and place" assembly. The profile of this device is approximately 1.8 mm in thickness or greater due to prefabricated cover. The device has an "up/down" orientation and must be mounted right side up. The ceramic cover encloses primarily only the top of the wound toroid. The cover and the pair of connection terminals are made separately and must accomplished in multiple steps. Also, the cover and the pair of connection terminals are also made separately, thereby adding to the cost of manufacture and reducing reliability due to the interconnect.

Another representative of this genre of low profile inductor is made by Coiltronics sold under the trademark THIN-PACs. As with Coilcraft product, the prefabricated cover essentially surrounds only the top of the toroid leaving most of the bottom open. The thickness of this device is approximately 1.8 mm in thickness or greater, again due to the prefabricated cover. Also, as with the Coilcraft product, adhesive must be used to hold the wound toroid in place when the prefabricated cover is applied.

A low profile surface mounted inductor of comparable electrical performance having a thickness of no more than 1.5 mm and the same outline dimensions otherwise, that can be made in a single step, and has either an "up or down" mounting orientation is not found in the prior art.

SUMMARY OF THE INVENTION

The invention is a surface mountable low profile inductor. A toroidal core is provided. At least one predetermined length of wire having a predetermined diameter is also provided. The wire is wound around the toroidal core in a plurality of loops to provide a wound toroid. A pair of lead ends corresponding to each length of said wire extends from the wound toroid. An integrated molded housing features a cover and at least two wrap posts. Each of the wrap posts has a wire end. The cover at least partially encapsulates the wound toroid. In the preferred embodiment, each wrap post at least partially encapsulates the corresponding lead end of said wire so that a wrap portion of the lead end extends through its wrap post. However, lead ends may not exit the wrap post but instead may exit the periphery of the cover. Finally, the inductor is completed by providing a plurality of surface mount pads with each surface mount pad provided by the wrap portion being wrapped around its corresponding wrap post.

Therefore, it is an aspect of the invention to provide a surface mounted low profile inductor that can be insert-molded in a single step.

Another aspect of the invention to provide an aspect of the invention to provide a surface mounted low profile inductor that has a profile of less than or equal to 1.5 mm in thickness without compromising other dimensions or electrical performance.

Still another aspect of the invention is to provide a surface mounted low profile inductor that can be used with standard "pick and place" positioning techniques well known in the art.

Another aspect of the invention to provide an aspect of the invention to provide a surface mounted low profile inductor that can also be mounted upside down as well as right side up.

Finally, it is an aspect of the invention to provide a surface mounted low profile inductor that be inexpensively produced yet meets today's IC performance and size requirements.

BRIEF DESCRIPTION OF THE DRAWINGS

FIG. 7 is a side view of an alternative embodiment of invention.

FIG. 8 is an isometric view of an alternative embodiment illustrating an exit point for the wire leads.

FIG. 9 is a side view of another alternative embodiment illustrating another exit point for the wire leads.

DETAILED DESCRIPTION OF THE INVENTION

Figure 1:
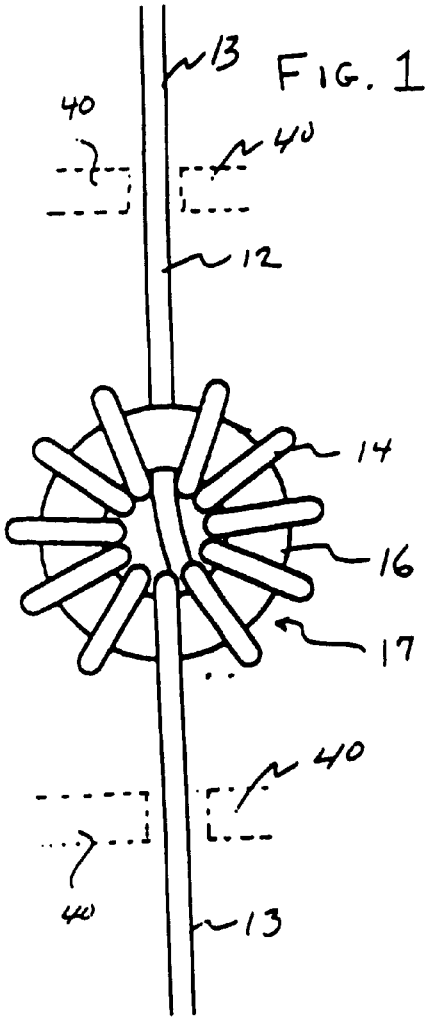
FIG. 1 is a top/bottom view of toroidal core wound with wire.
Figure 2:
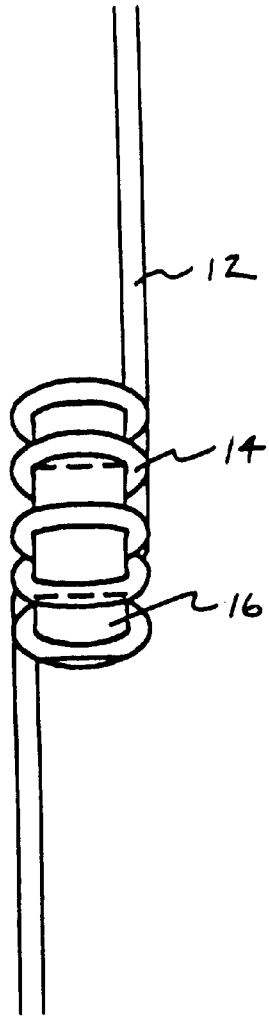
FIG. 2 is side view of the wound toroid as shown in FIG. 1.

The invention is a low profile toroid inductor. As shown in FIGS. 1 and 2, toroidal core 16 is looped with a plurality of turns 14 to provide wound toroid 17 with lead ends 13 extending outward from wound toroid 17 approximately 180 degrees apart. Toroidal core 16 is preferable made from ferrite or other metal well known in the art for this purpose. The diameter of the un-insulated copper wire 12 and number of turns of wire 12 that is to be wrapped around toroidal core 16 is determined by the circuit requirements using techniques well known in the art.

Once wound toroid 17 has been completed, it is placed in a mold (not shown). Lead ends 13 and the wound toroid are positioned within the mold using opposing pairs of wire guides 40.

Figure 3:
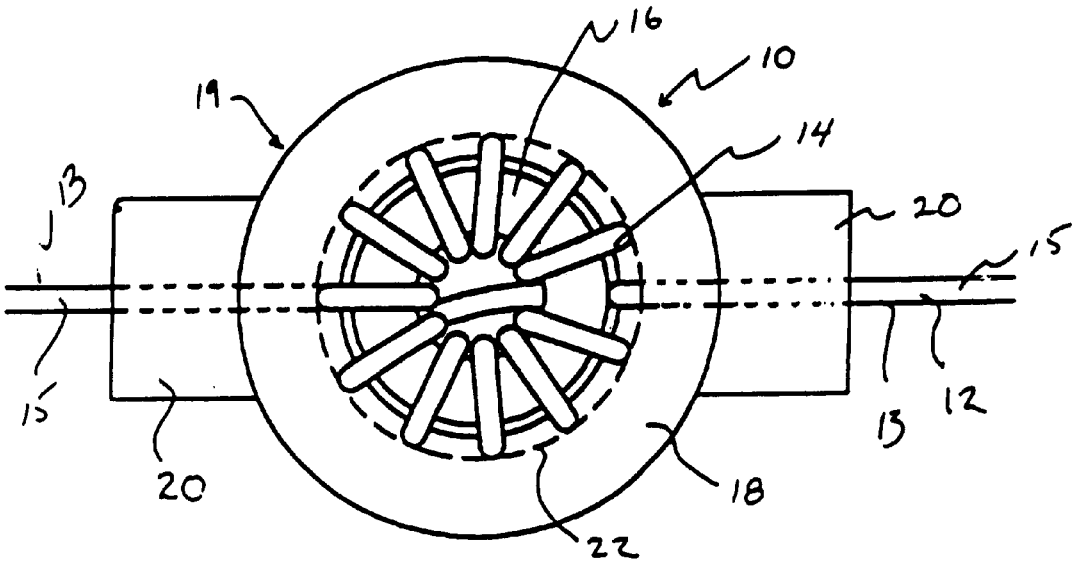
FIG. 3 is a partial cut-away top view of the integrated cover and opposing wrap posts encapsulated the wire wound toroid.
Figure 5:
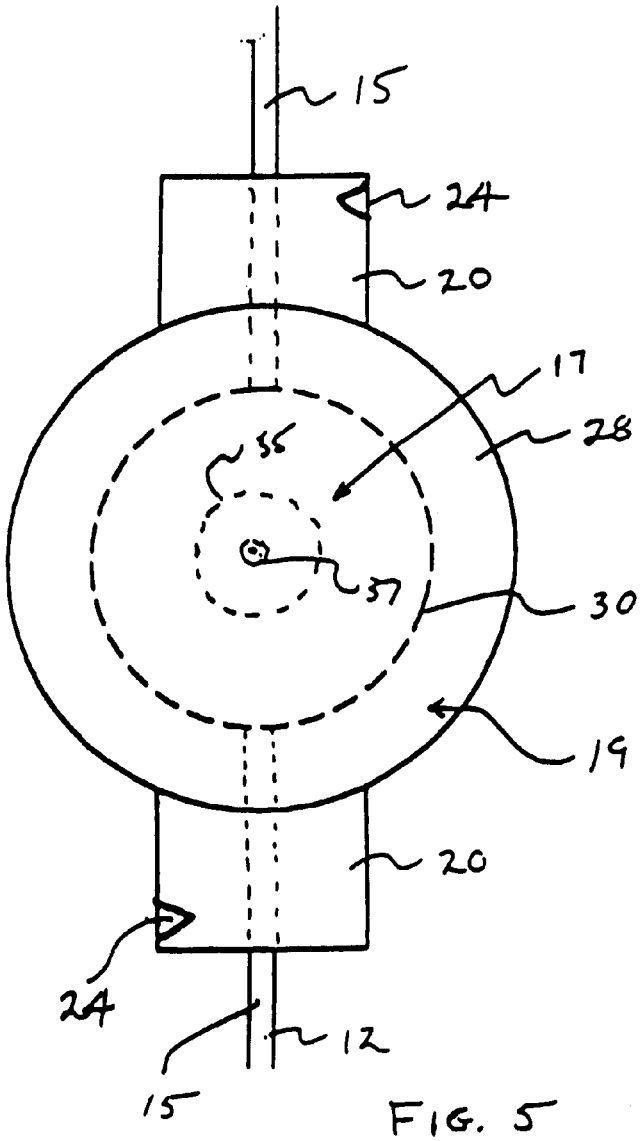
FIG. 5 is a top view of the inductor in accordance with the invention.

As shown in FIGS. 3 and 5, housing assembly 19 is molded around wound toroid 17 and lead ends 13 which provides cover 18 which substantially encapsulates toroid 17 and wrap posts 20 which preferably partially encapsulate lead ends 13 such that portion 15 extends from each wrap post 20. Note that housing assembly is provided in a single step without needing adhesive to hold wound toroid 17 in place while the cover is applied. Also, wrap posts 20 are also provided in the single step molding process thus eliminating the need to attach separate terminal connectors to the inductor as found in the prior art. While only a pair of wrap posts 20 are shown, it is possible to have multiple wrap posts corresponding to the desired number of lengths of wire looped around the toroid core.

Figure 4:
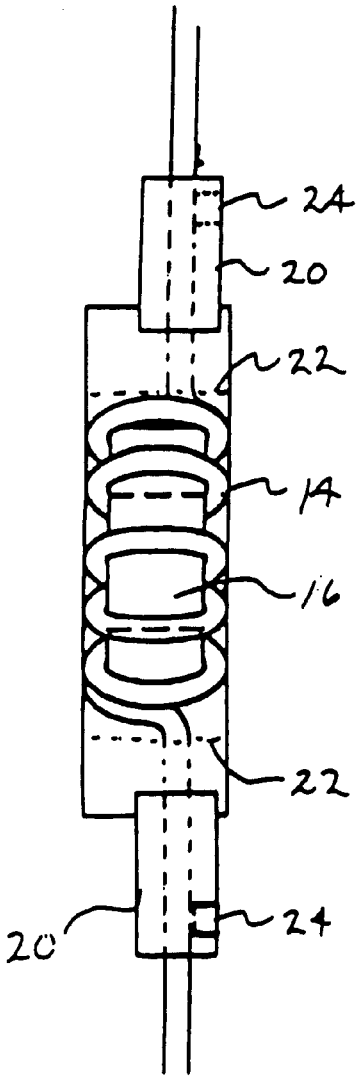
FIG. 4 is a partial cut-away side view of encapsulated core shown in FIG. 3.

The preferable material used to mold housing 19 is a liquid crystal polymer such as Dupont's ZENITE, however, other moldable materials may also be used as well. As shown in FIGS. 3 and 4, cover 18 has been removed along lines 22 and 22 to show toroid 17 in place within cover 18. Cover 18 is shown in FIG. 5 in its preferred embodiment as substantially covering toroid 17, both top and bottom. Toroid 17 lies inside cover 18 of housing assembly 19 positioned within line 30.

As shown in FIGS. 4 and 5, notches 24 are molded into wrap posts 20. Notches 24 are dimensioned to correspond to the diameter of wire 12. Notches 24 serve to assist wire portion 15 being wrapped around its corresponding wrap post 20 to provide connection pad 32 on each end of invention 10. Notches 24 also serve to hold pads 32 in place on their respective wrap post 20. Pads 32 may, if desired, be soldered (not shown) so that each loop of pad 32 is joined together for a better electrical connection once invention 10 has been mounted.

Figure 6:
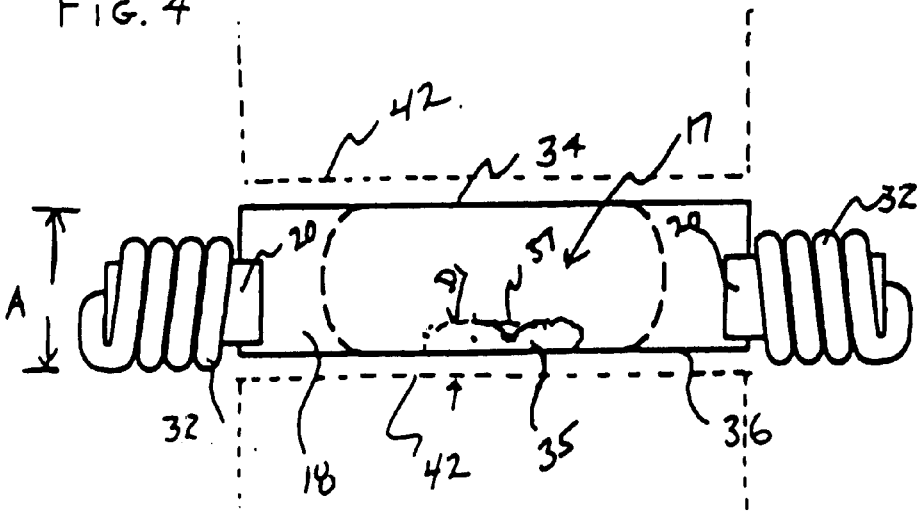
FIG. 6 is a side view showing the lead wires wrapped around the opposing wrap posts to provide a pair of opposing connection pads.

As shown in FIG. 6, wrap posts 20 are positioned relative to cover 18 so that once wrap posts 20 are wrapped with wire portion 15 to provide mounting pad 32, mounting pad 32 extends slightly below the bottom surface 36 of invention 10. Top surface 34 has a substantial flat portion that can be used for vacuum "pick and place" positioning techniques. Bottom surface 36 is also the mounting surface. Blind hole 35 is molded into bottom surface 36 of invention 10. The feature in the mold (not shown) that molds blind hold 35 serves to center toroid 17 in the mold so that the plastic will flow uniformly around the outside diameter of the toroid to the terminal forms. Injection molding pressure is directed substantially to the center of the bottom of the mold cavity thus pushing toroid 17 to the top of the cavity. Note that the part is inverted when molded. In this manner, the top surface 34 is minimally disturbed wire 12 wound on toroid 17 so that a smooth flat top surface 34 is formed. This is necessary to permit a user to use readily available vacuum suction equipment to handle the invention during automated assembly.

Still another advantage provided by blind hole 35 relates to the fact that plastics and ferrous core materials have different coefficients of thermal expansion. The properties of a ferrous core material will change when under mechanical stress. Invention 10 operates over a wide range of temperatures. Thus, the toroid core 16 experiences less mechanical stress due to the absence of plastic inside the hole of the toroid 17. Most importantly, gate vestige 37, which is the excess plastic remaining on the molded part after the plastic has been injected, is prevented from protruding beyond the mounting surface 36 as long as blind hole 35 has a depth D1 that is greater than or equal to the height of gate vestige 37 as shown in FIG. 6.

In the preferred embodiment, the thickness of invention 10 as provided by dimension A is minimized. Preferably, the thickness of invention 10 is 1.5 mm or less. However, this thickness may be exceeded depending on the electrical performance requirements. However, by elimination of the prefabricated cover, invention 10 will permit a lower profile than found with prior art devices. Also, note that invention 10 in the preferred embodiment has a top 34, bottom 36 orientation.

During the molding process, mold core pins 42 are used to achieve the flat surface on top surface 34 and knock invention 10 out of the mold (not shown).

As shown in FIG. 7, an alternative embodiment of invention 10 is illustrated. A "top/bottom" orientation can be eliminated by positioning wrap posts 20' equidistant between surfaces 34 and 36. Thus, a blind hole 35 could be positioned on either surfaces 34 and 36. A blind hole 35 could also be provided on both surface 34 and on surface 36.

Pads 32' are adjusted so that loops of pads 32' extend slightly above and below surfaces 34 and 36, respectively, to facilitate proper mounting. The thickness of this embodiment as provided by dimension A' is only slightly larger, yet the "up/down" mounting orientation has been eliminated. Further, a substantial flat portion can provided on both surfaces 34 and 36 via mold core pins so that either surface can be selected for "pick and place" positioning.

As shown in FIGS. 8 and 9, wire portion 15 does not need to exit the ends of wrap posts 20. Wire portion 15 can exit anywhere on housing assembly 19 as long as wire portion 15 does not exit through surface 36 if configured in a "top" mounted embodiment or surfaces 34 and 36 if the "top/bottom" configuration is eliminated as shown in FIG. 7.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A surface mountable inductor comprising:

a toroidal core;

at least one predetermined length of wire having a predetermined diameter, wherein said wire is wound around said toroidal core in a plurality of loops to provide a wound toroid such that at least one pair of lead ends of said wire extend from said wound toroid with each lead end of said at least one pair of lead ends being substantially opposite from one another;

an integrated molded housing molded around said wound toroid; wherein said molded housing has a gate vestige; and wherein said integrated molded housing comprises a cover having a mounting surface and a pair of wrap posts with each wrap post having the lead end of said at least one pair of lead ends molded therein such that a portion of the lead end extends beyond its said wrap post to provide a wrap portion; and a blind hole substantially centered in the mounting surface of said cover wherein said blind hole has a depth that prevents the gate vestige from protruding beyond the mounting surface of said cover; and a pair of surface mount pads for each of said at least one lead ends, with each surface mount pad provided by wrapping the wrap portion of the lead end around its corresponding wrap post a plurality of turns and with each turn being adjacent to the previous turn.

2. The surface mountable inductor of claim 1 wherein each of said wrap posts further comprises at least one molded notch dimensioned to correspond to the diameter of said wire.

3. The surface mountable inductor of claim 1 wherein said cover further comprises at least one flat surface having a surface area that is dimensioned for being engageable by a vacuum pick up apparatus.

4. The surface mountable inductor of claim 1 wherein said cover comprises two substantially flat opposing surfaces such that said inductor can be mounted without having an "up/down" orientation.

5. The surface mountable inductor of claim 1 wherein at least one lead end exits said integrated molded housing at a location other than said wrap posts.

6. The surface mountable inductor of claim 1 wherein said housing has a top and a bottom surface and wherein said pair of wrap posts is equidistant from the top and the bottom surfaces of said housing.

7. The surface mountable inductor of claim 1 wherein said housing has a top and a bottom surface and wherein said pair of wrap posts is nearer said bottom surface than said top surface thus providing an up/down orientation.

8. The surface mountable inductor of claim 1 wherein said cover has a second mounting surface which is opposed to the mounting surface and wherein said second mounting surface also has a blind hole that is substantially the same as the blind hole in the mounting surface of said cover such that said surface mountable inductor can be mounted with either the mounting surface or the second mounting surface facing down.

* * * * *